United States Patent [19]

Coffrin

[11] Patent Number: 4,819,568

[45] Date of Patent: Apr. 11, 1989

[54] MULTI-WAY PORTABLE WRITING DESK

[76] Inventor: John C. Coffrin, 38 Village Green, West Lebanon, N.H. 03784

[21] Appl. No.: 132,454

[22] Filed: Dec. 14, 1987

[51] Int. Cl.[4] ..... A47B 73/00

[52] U.S. Cl. ..... 108/43; 297/2; 297/439; 108/13

[58] Field of Search ..... 108/43, 50, 12, 13, 108/91, 92, 99; 248/444, 459, 97, 99; 297/457, DIG. 2, 1, 2, 3, 438, 438, 439

[56] References Cited

U.S. PATENT DOCUMENTS

| | | | |
|---|---|---|---|
| 297,219 | 4/1884 | Anthony | 108/43 |
| 527,108 | 10/1894 | Cooper | 108/43 X |
| 2,054,098 | 9/1936 | Rich | 248/444 |
| 2,244,912 | 6/1941 | Kollander | 297/439 |
| 2,384,234 | 9/1945 | Breese | 297/2 |
| 2,505,814 | 5/1950 | Voorhorst | 248/461 X |
| 3,058,793 | 10/1962 | Schultz | 108/13 |
| 3,113,788 | 12/1963 | Johnston | 297/439 X |
| 3,314,200 | 4/1967 | Schuster | 297/457 |
| 3,334,942 | 8/1967 | Breslow | 297/1 |
| 3,338,544 | 8/1967 | Schmidt | 248/459 X |
| 3,791,314 | 2/1974 | Berretta | 108/43 |
| 4,095,533 | 6/1978 | Leveille | 211/132 X |
| 4,123,852 | 11/1978 | Zimowski | 108/49 X |
| 4,228,745 | 10/1980 | Gale | 297/439 X |
| 4,462,636 | 7/1984 | Markson | 297/439 |

*Primary Examiner*—Kenneth J. Dorner

*Assistant Examiner*—José V. Chen

*Attorney, Agent, or Firm*—Sughrue, Mion, Zinn, Macpeak & Seas

[57] ABSTRACT

A multi-way portable writing desk is formed of a unitary structure of generally U-shaped configuration consisting of a flat rectangular base panel for placement horizontally between the legs of the user and partially underlying the same or, horizontally beneath one leg of the user and to the side thereof, a right angle vertical riser panel having a lower end joined to one end of the base panel and extending vertically upward at right angles thereto and a lap panel integral with the upper end of the riser panel and extending parallel to the base panel, to the same side of the riser panel and overlying the base panel and being spaced from the base panel a distance capable of accommodating a leg or legs of the user whether the user straddles the vertical riser panel or the riser panel extends vertically upwardly along the outside of one of the legs of the user and the lap panel extends horizontally across the leg and overlies the lap of the user. The base panel, the riser panel and the lap panel may be respectively hinged together on arms which project horizontally outwardly of the riser panel at upper and lower ends thereof. The base panel and lap panel may be pivoted 270° from deployed horizontal positions to retracted vertical positions where the base panel, the lap panel and the riser panel extend parallel to each other in side by side vertically retracted fashion.

4 Claims, 1 Drawing Sheet

FIG. 1
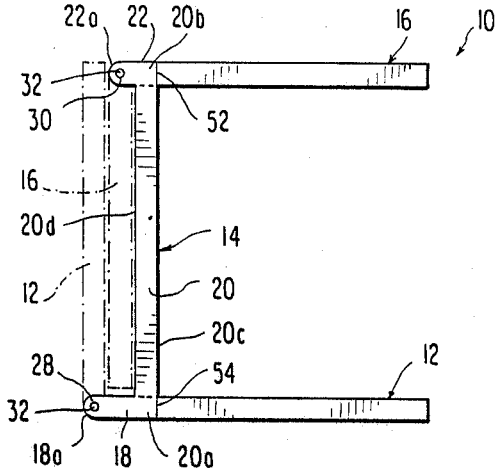
FIG. 3
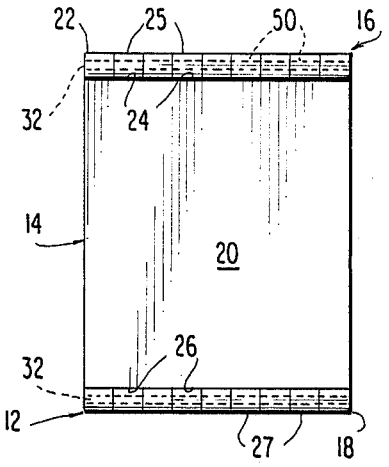
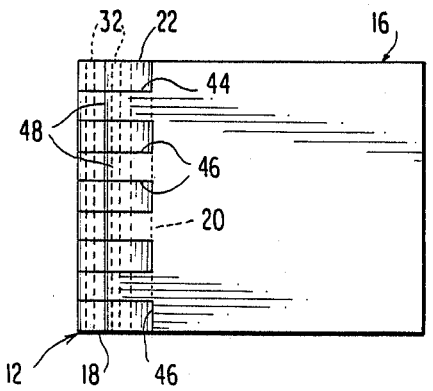
FIG. 2
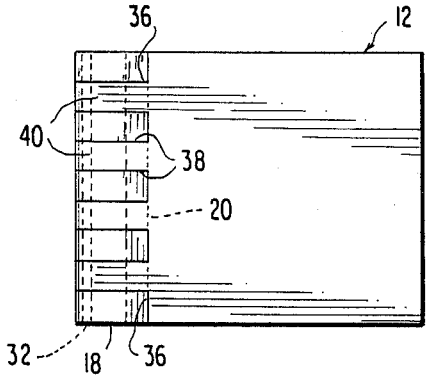
FIG. 4
FIG. 5
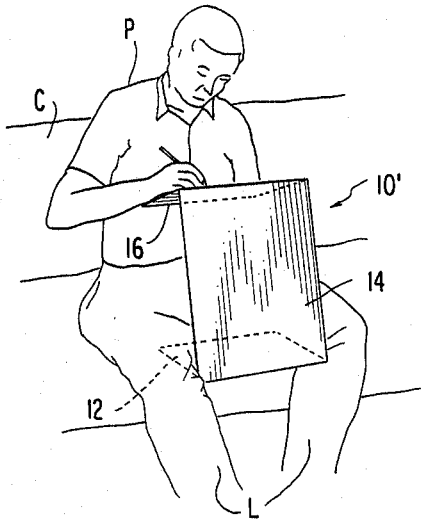
FIG. 6
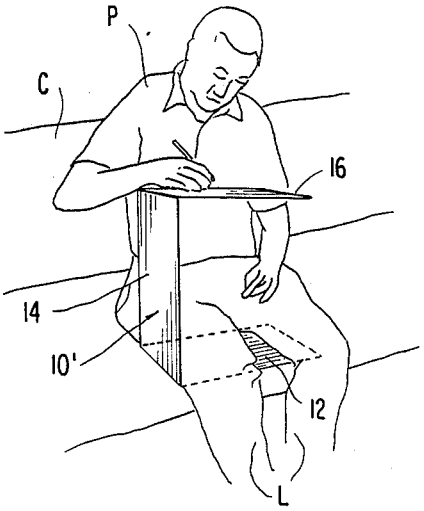

MULTI-WAY PORTABLE WRITING DESK

FIELD OF THE INVENTION

This invention relates to writing desk which provide a generally horizontal support surface in front of the waist or lower stomach portion of a person seated or lying in bed, and more particularly, to a simplified writing desk of U-shaped form permitting the person or user to straddle the desk with the vertical riser within the crotch and between the legs of such user or alternatively, permitting the writing desk to positioned so that a base panel underlies one leg of the user, a horizontal support surface projects across the outside of said leg and is located in front of the waist or lower stomach portion of the user and from one side rather than the front.

BACKGROUND OF THE INVENTION

One such conventional writing desk, known as a "lap" desk, is set forth in U.S. Pat. No. 3,652,051 in which the desk includes a top horizontal panel defining the desired horizontal support surface and the desk is provided with a pair of depending legs or support panels for embracingly receiving the upper leg portions of a person therebetween, when the person or user is seated in a chair or upright, upon a bed. The legs or support panels may be hingedly supported from the top panel for ready swinging movement into collapsed positions closely underlying the undersurface of the top panel of the desk.

In an earlier U.S. Pat. No. 842,018 to Russell, a writing desk is formed of a pair of right angle boards and a third diagonal or oblique book support panel fixed to a riser at its upper end extends obliquely upward and away from a base with a right angle vertical support board interposed between the base and the oblique reading desk panel. The vertical panel or board constitutes a brace and rigidly holds the other members connected together. Such writing desk as exemplified by Russell permits the oblique panel to face the user when used as a slanted reading desk or alternatively, the unit is turned on its base so that the horizontal member joining the base and the oblique book support panel functions as a horizontal writing surface.

Additionally, U.S. Pat. Nos. 3,058,793 to Schultz and 3,361,088 to Hodgkin show adjustable multi-purpose tables. In one case a U-shaped member may be inverted to function as a base or may stand upended for supporting the table top thereon. In the other, the table includes two right angle panels which function alternatively as table tops, when the table is upended and when in normal upright position.

It is therefore a primary object of the present invention to provide an improved multi-way portable writing desk which may be positioned facing the person or user or at right angles to the person and wherein, a base panel thereof may be positioned beneath a leg or the person or a user may straddle said base panel, such that the user or person seated or lying in bed acts to maintain the writing desk in proper position and prevents its toppling during use.

A further object of the invention is to provide a writing desk of this type which is foldable, which may be readily erected, handled or stored in a compact condition and wherein, a base panel and a lap panel fold naturally into side by side fashion relative to a riser panel to which they are hinged at opposite ends.

It is a further object of the invention to provide a multi-way portable writing desk which may be of rigid sheet metal or plastic form and which may be economically manufactured and which is practically indestructible.

These together with other objects and advantages which will become subsequently apparent, are resided in the details of construction and operation as more fully described herein, reference being had to the accompanying drawings forming a part thereof, wherein like numerals refer to like parts throughout the multiple embodiments.

BRIEF DESCRIPTION OF THE DRAWINGS

FIG. 1 a side elevational view of a multi-way portable writing desk forming a preferred embodiment of the present invention.

FIG. 2 is a top plan view thereof.

FIG. 3 is a rear elevational view thereof.

FIG. 4 is a bottom plan view thereof

FIG. 5 is a perspective view of the multi-way portable writing desk forming a second embodiment of the invention illustrating one nature of use, positioned in front of the user with the legs of the user straddling the riser panel and overlying the base panel thereof.

FIG. 6 is a further perspective view of the embodiment of FIG. 5, with the writing desk being mounted to the side of the user and with the base panel underlying one leg of the user.

DESCRIPTION OF THE PREFERRED EMBODIMENT

Referring specifically to FIGS. 1–4 inclusive, a multi-way portable writing desk is shown, in one form, at 10 and is comprised of three principal elements, a hinged base panel 12, a vertical riser panel 14 and a hinged lap panel or horizontal support panel 16. Each of the panels 14 and 16 may be formed of wood, plastic or the like and, in the form illustrated, are formed of molded plastic. The riser panel 14 is of generally U-shaped and including a lower rear flange or arm 18 which extends at right angles to side wall 20, specifically being integrated to the lower end **20*a* of said side panel. In similar fashion, an upper rear flange or arm 22 is integral with, extends at right angles to, and projects from the upper end 20*b* of side wall 20. It is noted that the lower rear arm is of a longer lateral length than that of the upper rear arm 22. Further, the outer or free end 18*a* of the arm 18 is rounded as is true for the free end 22*a* of the upper arm 22. As may be seen in FIG. 3, the side wall 20 is provided with a series of rectangular slots 24 within its upper edge 20*b*, and similar slots 26 are provided within its lower edge 20*a*. A hole is drilled at 28 through lower arm 18, and a similar hole 30 is drilled through the upper arm 22 to permit hinge pins 32 to project, respectively therethrough for hinging connections between arms 18 and 22 of the user panel 14 and the base panel 12 and lap panel 16 to respective flanges of user panel 14. In that respect, as best seen in FIG. 4, the hinged base panel 12 is of rectangular plan form, and is provided with notches 34, 36 at opposite ends and intermittent rectangular slots 38 sized to the rectangular projections or fingers 27 defined by slots 26 within the user panel lower arm 19, FIG. 3 to define projection fingers 40 which interfit within the fingers 27 of user panel 14. Further, a hole 28 is drilled through user panel lower arm 18. In similar fashion, the hinged lap panel 16, as shown best in FIG. 2, is provided with edge notches 44, 46 at opposite sides and is further provided with rectangular slots 46 forming a series of projections or fingers 48 which interfit with fingers 25 of the upper rear arm 20, defined by slots 27 formed within. Further, fingers 48 are provided with aligned holes 50 of a diameter slightly larger than the diameter of a hinge pin 32 carried by the upper rear arm 20, such that the hinged lap panel 16 is hinged to the upper rear arm 22**.

The depth of slots 38 and corresponding end notches of both the hinged base panel 12 and the hinged lap panel 16 are such that when the base panel and lap panel 12, 16, are pivoted 270° from closed, folded position of the unit, to the open position shown in FIGS. 1–4, the bottom edges 52 of the hinged lap panel 16 abut the front face 20*c* of the side wall 20 maintaining the hinged lap panel at right angles to the user panel 14. The same is true for the hinged base panel, since its slots 38 are likewise formed relative to the hinged pivot axis as defined by the series of holes 28 within fingers 40, such that the rear edge 54 of slots 38, also abut the open front face 20*c* of side wall 20 and wherein, the hinged base panel is maintained at right angles to riser panel 14. Upon rotating the hinged base panel 12 and the hinged lap panel 16 270° from the position shown in FIGS. 1–4, the hinged lap panel 16 moves into a position parallel to and immediately adjacent rear face 20*d* of riser panel side wall 20, as shown in dotted lines, FIG. 1 at 16', due to the short length of the upper rear arm 22 while, due to the longer length of the lower rear arm 18, and the position of its pivot pin 32, the hinged base panel 12 moves into vertically upright position immediately adjacent to and outside of the hinged lap panel 16, such that the riser panel 14, the hinged base panel 12 and the hinged lap panel 16 are in side by side parallel positions, with the hinged lap panel 16 sandwiched between the hinged base panel 12 and riser panel 14.

Referring next to the embodiment of the invention shown in FIGS. 5 and 6, which like the first embodiment may function as a "writing desk" or "reading desk" and while not of conventional lap desk form, that is being positioned on the lap, presents a horizontal writing surface which overlies the lap of the user in the same manner as the first embodiment. In this case, the writing desk indicated generally at 10', is formed of a single piece of sheet metal or alternatively plastic which is bent into U-shape, turned on its side and in the manner of the first embodiment, consist of a base panel 12, a right angle riser panel 14 and a horizontal lap panel 16, which is at right angles to the riser panel 14. The base panel and lap panel 12, 16, for example, may be 16"×16" while, the connecting portion of the unitary sheet metal desk 10', i.e. the riser panel, may be 20"×16". In FIG. 5, the user or person P is shown as sitting on a chair C, with the base panel 12 inserted between the user's legs L, with the riser panel 14, in front of the user P and the opening of the U-shaped desk 10' facing the user. This presents the lap panel 16 directly in front of the user and about waist level. The base panel 12 maintains the "desk" 10' in position, in a stable fashion. In this embodiment, there are no hinges to facilitate folding of the desk. The lateral width of 16" for the user panel connecting portion of the U permits the user to straddle the vertical riser panel 14 in comfort. Alternatively, as shown in FIG. 6, the U-shaped desk may be positioned to one side of the user or person P, with the base panel 12 projecting under one of the user's legs L, the riser panel 14 extending vertically upwards with the plane of the riser panel 14 parallel to and outside the leg L and with the lap panel 16 projecting horizontally across and over said leg L and immediately in front of the person P, at waist level.

Such desk 10 or 10' in either form is highly versatile, and may be employed by persons whether lying in bed, or seated, and even while seated within an automobile or light vehicle. The desk 10' can be formed of molded plastic and the base panel 12, riser panel 14 and lap panel 16 may be somewhat flexible, such that the lap panel 16 flexes towards the base panel 12 and thus at a slight oblique angle. This is highly desirable when the person P straddles the riser panel 14, facing the opening of the U-shaped desk.

The foregoing is considered as representative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention as claimed.

What is claimed is:

1. A multi-way portable writing desk for use by a user comprising: a unitary structure of generally U-shaped configuration consisting of a flat, rectangular base panel for placement horizontally between legs of the user and partially beneath buttocks of the user or horizontally beneath a leg of the user and at one side thereof, a right angle vertical riser panel having upper and lower ends, said lower end being joined to one end of the base panel and extending upwardly at right angles thereto, and a lap panel integral with the upper end of said riser panel and extending parallel to the base panel, on the same side of said riser panel as said base panel and overlying said base panel and being spaced from said base panel a distance capable of accommodating a leg or legs of the user, such that the lap panel may overlay a lap of the user whether, the U-shaped unitary structure is positioned on its side, with an open end of the U-shaped structure facing a waist of the user and with the legs of the user straddling the riser panel or positioned to a side of the user, with the base panel inserting beneath a leg of the user and with the riser panel extending vertically upward along the outside of the user's leg and wherein said base panel, said riser panel and said lap panel are formed of planar members, said riser panel comprises an upright side wall, integral upper and lower arms projecting at right angles to said upright side wall and joined to opposite, top and bottom edges of said side wall on a rear face thereof and terminate in free ends, and means for hinging said base panel and said lap panel at one end respectively to said free ends of said upper and lower arms of said side wall for pivoting about 270° from positions where said base panel and said lap panel extend parallel to each other and project at right angles from a front face of the side wall remote from the rear face thereof carrying said arms, to positions where, said base panel and said lap panel overlap and extend parallel to said side wall and in proximity to said side wall rear face from which said arms project and projecting upwardly and downwardly from respective arms.

2. The multi-way portable writing desk as claimed in claim 1, wherein said riser panel comprises a vertical side wall with said arms integral therewith at upper and lower ends thereof, said arms are of different lengths and pivot connections are provided within respective arms at different distances from the side wall, such that the base panel and the lap panel extend parallel to each other in side by side position, when rotated from a deployed position at right angles to said side wall to a retracted position extending parallel to said side wall.

3. The multi-way portable writing desk as claimed in claim 2, wherein said arms at the ends remote from the side wall are slotted at longitudinally spaced positions over the width of the arms, and said base panel and said lap panel have transversely spaced slots over the width of the same at corresponding offset positions to the slots within said arms, thereby defining interfitting hinged fingers for said base panel and said lap panel and respective riser panel arms, and wherein aligned holes are formed through said arms and respective ends of said base panel and said lap panel at said interfitting fingers, and pivot pins project through said aligned holes forming hinges connecting the base panel and the lap panel to respective arms of said riser panel; thereby constituting said hinging means.

4. The multi-way portable writing desk as claimed in claim 3, wherein said slots within the end of said lap panel and said base panel are of a length such that, when said base panel and lap panel are deployed in spaced horizontal parallel positions projecting outwardly of said riser panel front face at right angles thereto, the ends of the slots of said lap panel and base panel abut the front face of the riser panel to maintain the lap panel and base panel in deployed, horizontally spaced parallel position to permit said assembly to operate as a writing desk with said lap panel gravity locked into horizontal overlying position with respect to the lap of the user.

* * * * *